US007516906B2

(12) United States Patent
Cooke

(10) Patent No.: US 7,516,906 B2
(45) Date of Patent: Apr. 14, 2009

(54) FUEL INJECTOR

(75) Inventor: Michael P. Cooke, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 223 days.

(21) Appl. No.: 11/035,191

(22) Filed: Jan. 13, 2005

(65) Prior Publication Data

US 2005/0173564 A1 Aug. 11, 2005

(30) Foreign Application Priority Data

Jan. 13, 2004 (EP) ..... 04250133

(51) Int. Cl.
*F02M 47/02* (2006.01)
*B05B 1/30* (2006.01)

(52) U.S. Cl. ..... 239/88; 239/584

(58) Field of Classification Search ..... 239/88–93, 239/585.1–585.5, 533.2, 533.7, 533.9, 533.11, 239/533.12, 584; 251/129.15, 129.21, 127
See application file for complete search history.

(56) References Cited

U.S. PATENT DOCUMENTS

| | | | | |
|---|---|---|---|---|
| 4,803,393 | A * | 2/1989 | Takahashi | 310/328 |
| 6,024,297 | A * | 2/2000 | Greeves | 239/96 |
| 6,062,533 | A * | 5/2000 | Kappel et al. | 251/57 |
| 6,082,516 | A * | 7/2000 | Willer | 192/223.2 |
| 6,213,414 | B1 * | 4/2001 | Stier et al. | 239/584 |
| 6,293,254 | B1 | 9/2001 | Crofts et al. | |
| 6,311,950 | B1 | 11/2001 | Kappel et al. | |
| 6,360,721 | B1 | 3/2002 | Schuricht et al. | |
| 6,363,913 | B1 | 4/2002 | Milam et al. | |
| 2002/0088435 | A1 | 7/2002 | Kropp et al. | |
| 2002/0152992 | A1 | 10/2002 | Rodriguez-Amaya et al. | |
| 2002/0170537 | A1 | 11/2002 | Reusing | |
| 2003/0111548 | A1 | 6/2003 | Buck | |
| 2003/0146295 | A1 | 8/2003 | Lei | |
| 2004/0000600 | A1 | 1/2004 | Peters et al. | |

FOREIGN PATENT DOCUMENTS

| | | |
|---|---|---|
| DE | 19939451 | 11/2000 |
| DE | 10109610 | 2/2001 |
| DE | 19939446 | 3/2001 |
| DE | 19940293 | 3/2001 |
| DE | 10003252 | 8/2001 |

(Continued)

*Primary Examiner*—Davis D Hwu
(74) *Attorney, Agent, or Firm*—David P. Wood

(57) ABSTRACT

A fuel injector for use in an internal combustion engine includes a valve needle which is engageable with a valve needle seat to control fuel injection through an injector outlet. An actuator, typically in the form of a piezoelectric actuator stack, is arranged to control fuel pressure within a control chamber and a surface associated with the valve needle is exposed to fuel pressure within the control chamber. A load transmitter, preferably in the form of a motion inverter, transmits movement of the actuator to the valve needle. The load transmitter includes a bellows arrangement which is compressible and expandable in response to said actuator movement so as to vary fuel pressure within the control chamber, thereby to control movement of the valve needle relative to the valve needle seat. A piezoelectrically operable injector is operable in an energize-to-inject mode to provide efficient opening of the valve needle and to enable rapid closure of the valve needle.

24 Claims, 5 Drawing Sheets

FOREIGN PATENT DOCUMENTS

| | | |
|---|---|---|
| DE | 10056165 | 5/2002 |
| DE | 10141110 | 3/2003 |
| DE | 10162045 | 6/2003 |
| DE | 10221384 | 11/2003 |
| EP | 1098087 | 5/2001 |
| EP | 1111230 | 6/2001 |
| EP | 1284357 | 2/2003 |

* cited by examiner

FUEL INJECTOR

The present invention relates to a fuel injector for delivering fuel to a combustion space of a compression ignition internal combustion engine. In particular, but not exclusively, the invention relates to a fuel injector including a piezoelectric actuator for controlling movement of an injector valve needle.

A known fuel injector of the type comprising a piezoelectric actuator is described in our co-pending European patent application EP 1174615 A1. The injector includes a valve needle which is movable relative to a valve needle seat to control whether or not fuel is delivered through a plurality of injector outlets into an associated engine cylinder. A surface of the valve needle is exposed to fuel pressure within a control chamber. By controlling fuel pressure within the control chamber, valve needle movement towards and away from the valve needle seat is controlled.

The piezoelectric actuator includes a stack of piezoelectric elements and is arranged to control fuel pressure within the control chamber through a load transmitting arrangement in the form of a hydraulic amplifier. The hydraulic amplifier includes a control piston which is mechanically coupled to the actuator stack and slidable within a sleeve. The position occupied by a control piston within the sleeve determines the volume of the control chamber and fuel pressure within it. By controlling movement of the control piston, the pressure of fuel within the control chamber can be varied so as to control the movement of the valve needle. When fuel pressure within the control chamber is relatively high, the needle is urged into a closed, non-injecting state in which fuel delivery to the engine is prevented. If fuel pressure within the control chamber is reduced, the valve needle is caused to lift to an open, injecting state to initiate fuel injection. The injector can therefore be switched between injecting and non-injecting states by controlling fuel pressure within the control chamber by means of the piezoelectric actuator.

The piezoelectric actuator is controlled by applying a voltage across the piezoelectric stack to vary the stack length. For non-injecting states, the stack is energised to a first energisation level (an initial voltage level) and the stack is relatively long. In order to move the valve needle to initiate injection, the voltage across the stack must be reduced (an injecting voltage level) so as to reduce the stack length, which in turn causes the control piston to move. The voltages applied across the stack are selected to provide displacement of the stack through an amount that gives the required extent of movement of the control piston to switch the injector valve needle between its non-injecting and injecting states through the resultant fuel pressure changes within the control chamber.

The injector described previously is of the type in which the voltage across the stack is reduced to initiate an injection event (a so-called "de-energise-to-inject" injector). For a de-energise to inject injector, the actuator stack must be held at a relatively high voltage for non-injecting conditions (around 95% of injector service life). Injectors of this type enable accurate control of injection, particularly for low or normal injection flow rates, but a potential problem is anticipated for higher injection flow rates. In order to achieve higher injection flow rates it is necessary to lift the valve needle away from the valve needle seat by a relatively large amount (referred to as "high lift"), which requires the normally-high voltage across the stack to be reduced, by a relatively large amount during each injection.

When high drive voltages are applied for a prolonged period, problems can arise due to gradual electrochemical migration of the internal stack electrodes in the presence of moisture and, as a result, short circuiting may occur. An additional problem is that the relatively high degree of stack movement (i.e. contraction and extension) required for higher injection flow rates can reduce stack life due to the propagation of cracks within the piezoelectric material. It has also been recognised that high injection flow rates result in large pressure differentials within the flow passages to the injector outlets, which in turn create hydraulic forces acting against the valve needle lift forces, thus reducing the maximum attainable lift for higher injection pressures.

One way to address the problem of maintaining a high voltage across the stack for long periods of time is to configure the injector so that energisation of the stack results in injection (i.e. energise-to-inject as opposed to de-energise-to-inject). U.S. Pat. No. 6,520,423 describes a fuel injector of the energise-to-inject type. Although injectors of this type require high stack voltages to be maintained for only a relatively short time (i.e. about 5% of injector service life), they also suffer from the problem that high injection flow rates result in large pressure differentials across the length of the needle, reducing the maximum attainable needle lift. A further problem exists in that bi-polar operation of the piezoelectric stack is not usually possible with energise-to-inject injectors, as maintaining the stack at a high negative voltage for prolonged periods of time (around 95%) results in depolarisation of the stack. Energise-to-inject injectors are therefore not capable of achieving such high stack displacements, thus imposing a limit on the maximum attainable lift of the valve needle.

It is with a view to addressing at least one of the aforementioned problems that the present invention provides an improved fuel injector, as set out below.

According to the present invention, there is provided a fuel injector for use in an internal combustion engine, the fuel injector comprising a valve needle which is engageable with a valve needle seat to control fuel injection through an injector outlet, an actuator arranged to control fuel pressure within a control chamber, a surface associated with the valve needle being exposed to fuel pressure within the control chamber, a load transmission means for transmitting movement of the actuator to the valve needle, wherein the load transmission means includes a bellows arrangement which is compressible and expandable in response to said actuator movement so as to vary fuel pressure within the control chamber and to control movement of the valve needle relative to the valve needle seat.

The use of the bellows arrangement to transmit the actuation force of the actuator to the valve needle by controlling pressure variations in the control chamber is mechanically convenient.

In a preferred embodiment, the load transmission means takes the form of a motion inverter for converting movement of the actuator in one direction into movement of the valve needle in substantially the opposite direction. The invention is therefore particularly applicable to injectors of the type including a piezoelectric actuator for operation in an energise-to-inject mode i.e. where an increase in voltage applied across the stack results in an injection of fuel.

Preferably, the load transmission means further includes a sleeve which is co-operable with the bellows arrangement so as to impart movement of the actuator to the bellows arrangement.

In one embodiment, the surface associated with the valve needle is defined by a control piston which is coupled to the valve needle, wherein the control piston is slidable within the sleeve in response to fuel pressure variations within the control chamber.

In an alternative embodiment, the valve needle may be slidable directly within the sleeve in response to fuel pressure variations within the control chamber. It may be advantageous to provide a separate control piston, however, for ease of manufacture.

Preferably, the bellows arrangement includes a plurality of disc spring elements arranged in concertina fashion.

The valve needle is conveniently movable within a bore provided in a nozzle body, the disc springs being arranged in a concertina-like stack so that a lower one of the disc spring seals against a surface of the nozzle body and an upper one of the disc springs seals against the sleeve to define an internal bellows volume that is filled with fuel.

The disc springs are co-operable with one another, in use, so as to compress and expand the bellows arrangement in dependence upon actuation of the actuator and, thus, to vary the internal bellows volume that is filled with fuel. When the bellows are compressed, fuel is dispelled from the bellows volume to increase fuel pressure within the control chamber, thus applying an increased lift force to the valve needle, directly or via the control piston, to enable opening movement of the needle to initiate injection. When the bellows are allowed to expand, fuel is able to re-fill the bellows volume, reducing the fuel pressure within the control chamber and, thus, allowing the valve needle to re-seat against the valve needle seat to terminate injection.

Preferably, the valve needle seat is defined at one end of the valve needle and a chamber for receiving fuel is defined at the other end of the valve needle. Preferably, the chamber houses a valve needle spring which is arranged to urge the valve needle into engagement with the valve needle seat.

The injector may further comprise a fuel delivery path for delivering fuel to the injector outlet when the valve needle is lifted from the valve needle seat, wherein the valve needle includes communication means between the fuel delivery path and the chamber to aid opening movement of the valve needle.

The communication means preferably takes the form of an axial flow path provided within the valve needle which may extend part way along, or the entire length of, the needle axis.

The communication means may further include at least one radial flow path provided in the valve needle, one end of which communicates with the fuel delivery path and the other end of which communicates with the axial flow path.

The communication means is advantageous as it provides a means for aiding the opening force acting on the valve needle due to the effect of the fuel pressure drop in the region of the valve needle seat as injection is commenced being transmitted to the chamber through said communication means. In other words, there is a reduction in the force due to fuel pressure within the chamber at the upper end of the valve needle, which opposes the valve needle lift force, and this has the effect of aiding valve needle opening movement.

In a preferred embodiment, the communication means includes a damper valve arranged to define a restricted flow path between the axial flow path and the chamber. In a further preferred embodiment, the damper valve includes a damper valve member which is engageable with a seating, wherein the damper valve member adopts a seated position in circumstances in which the valve needle is lifting away from the valve needle seat, thereby to damp opening movement of the valve needle, and a lifted position in circumstances in which the valve needle is moving towards the valve needle seat, thereby to ensure closing movement of the valve needle is substantially undamped.

The provision of the restricted flow path in the damper valve provides a degree of damping of opening movement to prevent unwanted valve needle movement during injection and to improve control of valve needle movement. However, the ability of the damper valve member to lift from the seating ensures closing movement of the valve needle is substantially unaffected, as the restricted flow path is by-passed upon re-filling of the chamber at the upper end of the needle at the end of injection. Rapid closure of the valve needle can therefore still be achieved.

Preferably, the fuel delivery path includes a fuel delivery chamber defined between the valve needle and the nozzle body bore, and wherein the or each radial flow path is provided in the valve needle so as to communicate with the fuel delivery chamber.

In one embodiment, the injector includes a further restricted flow path defined within the valve needle to provide communication between the control chamber and the communication means so as to ensure eventual closure of the valve needle in the event of failure of the actuator. If the actuator should become stuck in the actuated (injecting) state, eventually fuel pressure within the control chamber will reduce due to the restricted flow of fuel out of the control chamber into the communication means.

In an alternative embodiment, in which the aforementioned axial flow path is not provided, the further restricted flow path may be provided in the sleeve or the nozzle body so as to communicate at one end with the control chamber, and thereby to allow fuel to escape from the control chamber at a restricted rate to ensure eventual closure of the valve needle in the event of failure of the actuator.

In a further preferred embodiment, the actuator is arranged within an actuator housing, wherein one end of an injector nozzle body is received within the actuator housing so that the other end of the nozzle body projects therefrom, the nozzle body defining an external seating surface of substantially part-spherical form for abutment with an internal abutment surface defined by the actuator housing. This arrangement ensures good concentricity can be achieved between parts of the injector, particularly for embodiments where bellows are replaced with a sleeve having an elongate skirt extension. It is preferred that the internal abutment surface is of frustoconical form.

According to a second aspect of the invention, therefore, there is provided a fuel injector for use in an internal combustion engine, the fuel injector including a valve needle which is movable within a bore provided in a nozzle body and engageable with a valve needle seat to control fuel injection through an injector outlet, an actuator for controlling movement of the valve needle, the actuator being arranged within an actuator housing, wherein one end of the nozzle body is received within the actuator housing so that a lower end of the nozzle body projects therefrom and wherein the nozzle body defines an external seating surface of substantially part-spherical form for abutment with an internal abutment surface of the actuator housing. It is generally preferred that the abutment surface of the actuator housing is of frustoconical form.

The use of the nozzle body having a part-spherical seating surface for engagement within the actuator housing is advantageous, even in an injector in which the load transmitting means does not include a bellows arrangement. This is because a degree of play is permitted between the actuator housing and the nozzle to accommodate misalignment between the parts which may arise, for example, as a result of manufacturing tolerances.

According to a third aspect of the invention, there is provided an injector for use in an internal combustion engine, the injector including a valve needle which is engageable with a valve needle seat to control fuel injection through an injector outlet, an actuator which is arranged to control fuel pressure within a control chamber, a surface of the valve needle being exposed to fuel pressure within the control chamber, a valve needle chamber for receiving fuel and being arranged at one end of the valve needle so that a surface associated with the valve needle is exposed to fuel pressure within the valve needle chamber, a fuel delivery path for delivering fuel to the injector outlet when the valve needle is lifted from the valve needle seat, wherein the valve needle is provided with communication means between the fuel delivery path and the chamber to aid opening movement of the valve needle.

The aforementioned preferred or optional features of the communication means of the first aspect may be incorporated in the second or third aspects of the invention also.

Although any of the aforementioned aspects of the invention may include an actuator having a stack of one or more piezoelectric elements. Other actuators, for example electromagnetically operable actuators, may be provided as an alternative.

If a piezoelectric actuator is provided, preferably the piezoelectric stack will be arranged within an accumulator volume for high pressure fuel, the sleeve and the bellows arrangement also being located within the accumulator volume and the internal bellows volume being sealed therefrom by end ones of the disc spring stack.

According to a fourth aspect of the invention, there is provided a load transmission device for use, in particular, within a fuel injector including an actuator, the load transmission device being operable to transmit actuation of the actuator to an injector component, in use, the load transmission device including a bellows arrangement including a stack of disc spring members.

In one particular embodiment, the fuel injector includes a piezoelectric actuator and is of the de-energise-to-inject type comprising a valve needle which is engageable with a valve needle seat to control fuel injection through an injector outlet, an upper end of the needle being movable within a sleeve coupled to the actuator and a surface associated with the valve needle being exposed to fuel pressure within the control chamber, the piezoelectric actuator being operable to control fuel pressure within the control chamber and the injector further comprising a bellows arrangement which is compressible and expandable in response to operation of the actuator and which serves to urge the sleeve towards the actuator.

The upper end of the valve needle may be movable directly within the sleeve or may be coupled to a control piston which moves within the sleeve.

Preferred and/or optional features of any of the aforementioned aspects of the invention may also be incorporated within the other aspects of the invention.

The invention will now be described, by way of example only, with reference to the accompanying figures in which.

Figure 1:
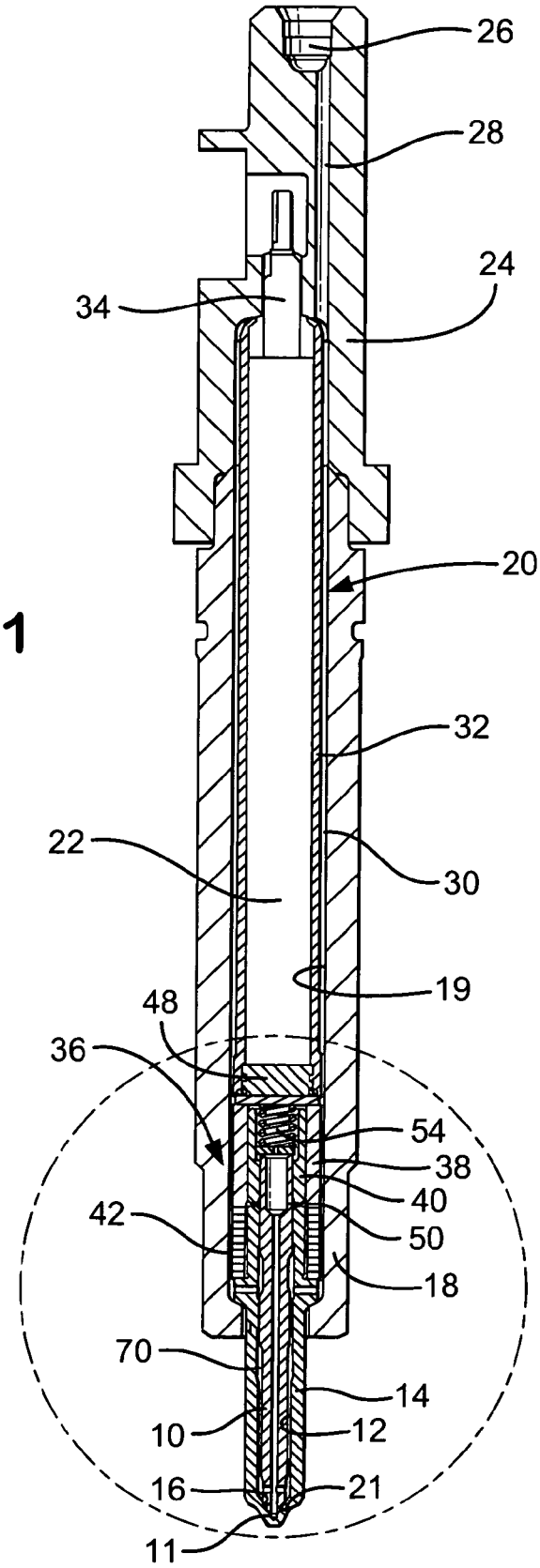
FIG. 1 is a sectional view of a fuel injector of the energise-to-inject type of a first embodiment of the present invention.
Figure 2:
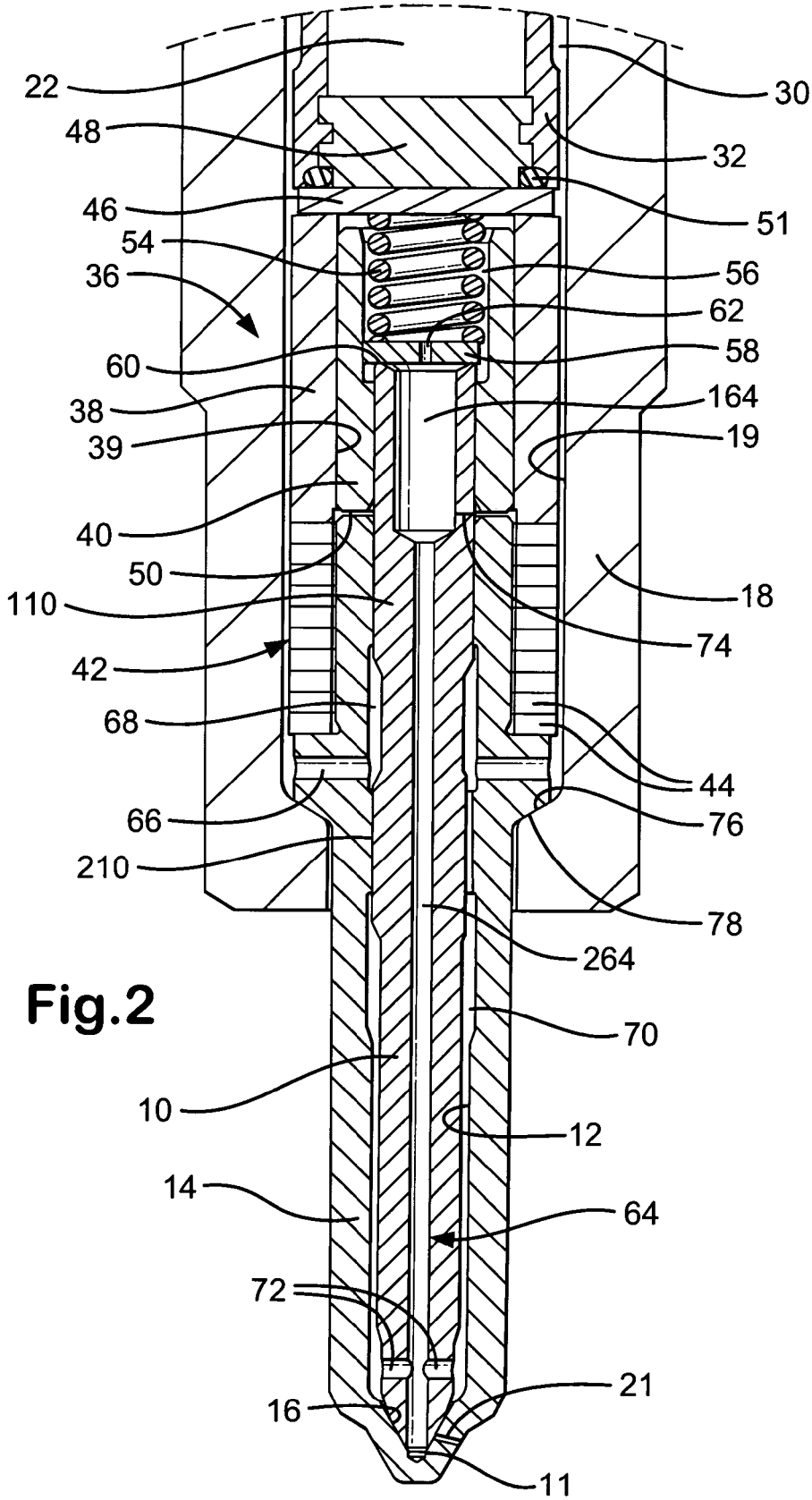
FIG. 2 is an enlarged sectional view of a part of the fuel injector in FIG. 1.

Referring to FIGS. 1 and 2, a fuel injector of the energise-to-inject type includes a valve needle 10 which is slidable within a bore 12 provided in an injector nozzle body 14. The valve needle 10 includes a valve needle tip region 11 which is engageable with a valve needle seat 16 defined by the bore 12 to control fuel injection to an associated combustion space or engine cylinder. The valve needle seat 16 takes the form of a twin valve seat, as discussed further below. The injector nozzle body 14 is received, at its upper end, within an actuator housing 18 for a piezoelectric actuator 20 including a stack 22 of elements formed from a piezoelectric material. The piezoelectric actuator 20 is operable to control movement of the valve needle 10 between a non-injecting position, in which it is seated against the valve needle seat 16, and an injecting position in which the valve needle 10 is lifted away from the valve needle seat 16.

As can be seen most clearly in FIG. 2, the valve needle 10 is shaped to include an upper guide region 110 which forms a sliding fit within the nozzle body bore 12 so as to guide axial movement of the valve needle 10 as it moves relative to the valve needle seat 16. The valve needle 10 is also shaped to include a lower guide region 210 to provide the same function.

The lower end of the nozzle body 14 projects from the actuator housing 18 so that injector outlets 21 (only one of which is shown) provided in said lower end extend into the engine cylinder. The upper end of the actuator housing 18 is received within an upper housing 24 (only shown in FIG. 1) including an inlet 26 for receiving high pressure fuel from a fuel source (not shown), typically in the form of a common rail. The inlet 26 communicates with a supply passage 28 provided in the upper housing 24. The actuator housing 18 is provided with a through drilling 19, an upper region of which defines an internal volume or "accumulator volume" 30. The supply passage 28 connects with the accumulator volume 30, which is thus filled with fuel at high pressure. The piezoelectric stack 22 is encapsulated within a sealant coating 32 and received within the accumulator volume 30 so that the stack 22 is exposed continuously to a large hydraulic force due to fuel pressure within the volume 30.

The piezoelectric actuator 20 is also provided with an electrical connector 34 to which a voltage is applied across the stack 22 from an external voltage source (not shown). Being of the energise-to-inject type, the piezoelectric actuator 20 is configured such that, when under non-injecting conditions, a relatively low voltage is applied across the actuator stack 22. With only a relatively low voltage across the stack 22, the stack length is relatively short and the valve needle 10 occupies a position in which it is seated against the valve needle seat 16 so that fuel injection does not take place through the outlets 21. When a relatively high voltage is applied across the piezoelectric stack 22, the stack length is caused to increase and as a result the valve needle 10 lifts away from the valve needle seat 16 to commence injection. Operation of the fuel injector will be described in further detail later.

Referring in particular to FIG. 2, extension and contraction of the stack 22 (in other words, stack movement) is transmitted to the valve needle 10 through a load transmission means, or load transmitter, referred to generally as 36, arranged within a lower region of the actuator housing bore 19. The load transmission means takes the form of a motion inverter which converts downward movement (extension) of the piezoelectric stack 22 into upward (opening) movement of the valve needle 10, and vice versa. The motion inverter includes a sleeve 38 which is received within the lower region of the accumulator volume 30, a control piston 40 which is slidable within a bore 39 of the sleeve 38 and a bellows arrangement 42 arranged immediately below the sleeve 38. The control piston 40 is coupled to the upper end of the valve needle 10 so that the two parts 10, 40 are movable together. The control piston 40 may be coupled to the valve needle 10 by means of an interference fit, although in an alternative embodiment the control piston 40 and the valve needle 10 may be formed as a single part.

The bellows 42 include a stack of disc spring members 44 which are arranged in a concertina fashion so that an upper disc spring of the stack is in sealed engagement with the lower surface of the sleeve 38 and a lower disc spring of the stack is in sealed engagement with a surface of the nozzle body 14. The bellows 42 define an internal bellows volume for high pressure fuel, which is that volume defined between adjacent ones of the disc springs 44. The bellows 42 are expandable and compressible in response to de-actuation and actuation of the stack 22 to vary the internal bellows volume, as discussed further below.

The piezoelectric stack 22 includes an end piece 48 in engagement with an intermediate load transmitting member 46. An annular seal 51 is provided between the load transmitting member 46, the end piece 48 and the stack sealant 32 so as to prevent ingress of fuel into the stack 22 from the accumulator volume 30. An upper surface of the sleeve 38 abuts the underside of the load transmitting member 46 so that, as the stack length is varied in use, movement of the stack 22 is transmitted through the load transmitting member 46 to the sleeve 38 and, hence to the disc springs 44. A control chamber 50 for fuel is defined between the lower surface of the control piston 40 and the upper end surface of the nozzle body 14 and fuel pressure within the control chamber 50 acts on the control piston 40 in an upward direction. An upper end of the nozzle body 14 projects into the bellows 42 so that an outer surface of the nozzle body 14 defines a clearance with the radially inner side of the bellows 42 through which fuel is able to flow between the internal bellows volume and the control chamber 50.

A valve needle spring 54 is received within a spring or damper chamber 56 defined within an upper end of the sleeve 38. The spring chamber 56 is filled with high pressure fuel which, together with the valve needle spring force, serves to urge the valve needle 10 into engagement with the valve needle seat 16. The pressure of fuel within the damper chamber 56 also serves to resist opening movement of the valve needle 10.

One end of the valve needle spring 54 abuts the lower surface of the load transmitting member 46 and the other end of the spring 54 abuts a damper valve arrangement 58, 60. The damper valve arrangement includes an annular damper valve 58 located within the spring chamber 56 and engageable with a valve seating 60 defined by an upper surface of the valve needle 10. The annular damper valve 58 defines a means for aiding rapid closure of the valve needle 10 at the end of injection, as discussed further below. The damper valve 58 is provided with a central drilling 62, one end of which communicates with the spring chamber 56 and the other end which communicates with an axially extending drilling 64 provided in the valve needle. The drilling 64 defines an axial flow path for fuel, including an upper region 164 of relatively large diameter and a lower region 264 of smaller diameter, which extends along the entire length of the valve needle 10 between the chamber 56 at the upper end and the valve needle tip 11 at the lower end. The axial flow path 64 forms a part of a communication means (such as a communication path) for aiding opening movement of the valve needle 10 (i.e. away from the valve needle seat 16) when injection is initiated, as discussed further below.

A fuel delivery means is provided between the accumulator volume 30 and the valve needle tip 11 to enable high pressure fuel to flow towards the region of the valve needle seat region at 16. The fuel delivery means includes an upper pair of radially extending drillings 66 in the nozzle body 14, an annular groove 68 provided at the upper end of the valve needle 10 and additional flutes (not shown in FIGS. 1 and 2) provided on the outer surface of the valve needle 10. The outer surface of the valve needle 10 and the nozzle body bore 12 are further shaped to define a fuel delivery chamber 70 between the groove 68 at the upper end of the valve needle and the valve needle tip 11 in the region of the valve needle seat 16. A second pair of radially extending drillings 72 are located towards the lower end of the valve needle 10. The second radially extending drillings 72 form part of the communication means for aiding opening movement of the valve needle 10 upon injection (as mentioned above) and define a radial flow path for fuel between the fuel delivery means 66, 68, 70 and the axial flow path 64.

From the foregoing description it will be appreciated that as the inlet 26, the supply passage 28, the accumulator volume 30, the radial flow paths 66 in the nozzle body 14, the flutes 68 on the valve needle 10 and the fuel delivery chamber 70 together provide a flow path to permit high pressure fuel that is delivered to injector at the inlet 26 to flow to the valve needle tip 11 in the region of the seat 16.

Operation of the injector will now be described in further detail. Starting from a non-injecting condition, the valve needle 10 is seated against the valve needle seat 16. Fuel is delivered through the delivery path 66, 68, 70 but is unable to flow past the valve needle seat 16 to the injector outlets 21 as the valve needle 10 is seated. In this condition, the voltage across the piezoelectric stack 22 is at an initial voltage level that is relatively low and so the stack 22 has a relatively short length. Typically, the initial voltage level across the piezoelectric stack 22 is just greater than zero volts. With the stack 22 in its contracted state, the force acting on the bellows 42 through the sleeve 38 is low so that the internal volume of the bellows 42 is at a maximum (i.e. the bellows are expanded) and is filled with high pressure fuel. Fuel pressure within the control chamber 50 is relatively low and, thus, the upward force acting on the control piston 40 due to fuel pressure in the control chamber 50 is relatively low.

Considering the forces acting on the valve needle 10, the net upward force acting on the valve needle 10 in the opening direction is determined by fuel pressure in the control chamber 50 which acts on the control piston 40 and hydraulic forces acting on the valve needle 10 due to fuel pressure within the delivery path 68, 70. The net downward force acting on the valve needle 10 in the closing direction is determined by fuel pressure within the spring chamber 56 and the valve needle spring force. When the piezoelectric stack 22 is in its contracted state, fuel pressure within the control chamber 50 is sufficiently low that the net downward force on the valve needle 10 exceeds the net upward force and, thus, the valve needle 10 remains seated against the valve needle seat 16.

In order to initiate injection, the voltage applied across the piezoelectric stack 22 is increased to a relatively high level (the "injecting voltage level"). As a result, the length of the piezoelectric stack 22 is increased, causing the end of the stack 22 to transmit movement through the intermediate transmitting member 46 to the sleeve 38. The sleeve 38 is thus caused to move downwardly within the accumulator volume 30, compressing the bellows 42 and causing the internal volume of the bellows 42 to be reduced. As a result of the bellows 42 being compressed, fuel is displaced from the internal volume of the bellows 42 and, thus, fuel pressure within the control chamber 50 immediately beneath the control piston 40 is increased.

As fuel pressure within the control chamber 50 increases, a point will be reached at which the upwardly directed force acting on the coupled needle 10 and piston 40 is sufficient to overcome the force due to fuel pressure within the spring chamber 56 acting in combination with the valve needle spring force. The control piston 40 therefore moves upwardly within the sleeve bore 39 and, hence, the valve needle 10 starts to lift from the valve needle seat 16. The upward force on the valve needle 10 due to fuel pressure within the delivery path 68, 70 also acts to lift the needle 10. As the valve needle 10 starts to lift from the valve needle seat 16, fuel within the delivery chamber 70 is able to flow through the outlets 21 into the engine cylinder, and injection takes place into the engine cylinder.

As the valve needle 10 starts to lift to commence injection, fuel pressure within the fuel delivery chamber 70 will reduce due to the flow of high pressure fuel through the outlet openings 21. Due to provision of the radial flow paths 72 and the axial flow path 64 in the valve needle 10, and the drilling 62 in the annular damper valve 58, the effect of this pressure reduction in the delivery chamber 70 will be apparent in the spring chamber 56 also due to fuel flowing from the spring chamber 56 to a region of lower pressure. As a result of pressure equalisation between the upper and lower ends of the valve needle 10, the net downward force on the valve needle 10 is further reduced, therefore benefiting the lift force on the valve needle 10 to aid further opening movement. It is a particular advantage of this feature of the invention that greater valve needle lift can be achieved for lower actuation forces (i.e. applied by the piezoelectric actuator). This is particularly relevant in circumstances in which higher injection flow rates, and hence higher valve needle lifts, are required. The extent to which flow through the axial flow path 64 influences valve needle lift will be determined by the axial position of the radial flow paths 72 along the valve needle axis and the flow area of the delivery chamber 70 supplying fuel to the outlet openings 21. These parameters can be selected carefully to provide the required valve needle opening characteristics.

Due to the provision of the restricted drilling 62 in the annular damper valve 58, the flow of fuel from the spring chamber 56 to the axial flow path 64 in the valve needle 10 occurs at a restricted rate, so that opening movement of the valve needle 10 is slightly damped. Damping of opening movement of the valve needle 10 has been found to be advantageous as it avoids unwanted oscillation and overshoot of the valve needle at the desired lift.

In order to terminate injection, the voltage across the piezoelectric stack 22 is reduced from the injecting voltage level to the initial voltage level, thereby reducing the length of the stack 22. As a consequence, the force transmitted to the bellows 42 is reduced so that they expand to increase the internal bellows volume as the individual disc springs 44 move apart from one another. As a result of the bellows 42 expanding, fuel pressure within the control chamber 50 is reduced and a point will be reached at which fuel pressure within the control chamber 50 is reduced to a sufficiently low level that the force of the valve needle spring 54, acting in combination with fuel pressure within the spring chamber 56, is sufficient to overcome the opening forces acting on the valve needle 10 to return the valve needle 10 against its seat 16. Injection of fuel through the outlet openings 21 is therefore terminated.

Whilst damping of opening movement of the valve needle 10 has been found to be advantageous, it is preferable for closing movement of the valve needle 10 to be achieved very rapidly. As the voltage across the stack 22 is decreased to the initial voltage level and the piezoelectric stack 22 starts to contract which increases the volume of the chamber 56, the control piston 40 is drawn downwards and, hence, the valve needle 10 starts to close. As the spring chamber volume starts to increase, fuel pressure within the spring chamber 56 starts to decrease and a point will be reached at which the annular damper valve 58 is caused to lift away from its damper valve seating 60 and fuel within the axial flow path 64 is able to flow past the damper valve seating 60 and into the spring chamber 56 at a relatively high rate, by-passing the restricted drilling 62. Fuel pressure within the spring chamber 56 therefore increases relatively quickly, assisting closing movement of the valve needle 10 and preventing any significant damping of said movement.

A further feature of the injector in FIGS. 1 and 2 is the provision of a restricted drilling 74 in the valve needle 10 which connects the control chamber 50 with the axial flow path 64 in the valve needle 10. When the valve needle 10 is lifted from the valve needle seat 16, the axial flow path 64 is at reduced pressure (by virtue of communication with the delivery chamber 70 through the radial flow paths 72) and so fuel will flow from the control chamber 50, at a restricted rate, through the restricted needle drilling 74 into the axial flow path 64. The restricted needle drilling 74 is sized so that, in normal circumstances, fuel pressure within the control chamber 50 cannot escape through the drilling 74 into the axial flow path 64 at a sufficiently high rate to influence operation, as described previously. However, should the piezoelectric stack 22 fail, so that it becomes stuck in the actuated (extended) state, high pressure fuel in the control chamber 50 will eventually decrease, due to flow through the restricted needle drilling 74, thereby allowing the valve needle 10 to close.

If particularly high injection flow rates are required, the injector may be configured such that the pressure differential across the length of the valve needle 10 to achieve high valve needle lift values is so great that reducing the voltage across the piezoelectric stack 22 to the initial voltage level (usually substantially zero volts) does not provide sufficient contraction of the piezoelectric stack 22 to ensure rapid closure the valve needle 10. If this occurs, the piezoelectric stack 22 may be driven to a lower voltage level, beyond the initial voltage level (i.e. typically a negative voltage level), so as to drive the stack 22 beyond its initial length, thus closing the valve needle 10 more rapidly. Once the valve needle 10 has been urged against the valve needle seat 16, the voltage across the piezoelectric stack 22 can be increased from the lower voltage level to the initial voltage level once again, thereby contracting the stack 22 back to its original length.

In order to permit all of the injector components to align appropriately, and particularly the stack 22, the sleeve 38, the control piston 40, the bellows 42 and the valve needle 10, the nozzle body 14 is shaped to define a step having a part-spherical seating surface 78 which seats against an internal abutment surface 76, of frustoconical form, defined by the actuator housing 18. The provision of the part-spherical seating surface 78 for engagement with the frustoconical abutment surface allows the position of the nozzle body to adjust in order to compensate for any slight errors in squareness, parallelism and concentricity between the injector parts 38, 42, 40, 22, 10 and so ensures that the piezoelectric stack 22 applies an evenly distributed axial force to the sleeve 38. This reduces damage being caused due to bending loads on the piezoelectric stack 22 and/or the valve needle 10.

In a particularly preferred embodiment, the valve needle 10 is arranged to seat against two valve seats (identified by 16), both of which are defined by the surface of the bore 12 in the nozzle body 14. This provides the advantage of an additional lift force for the valve needle 16 as it starts to move away from the seats 16 due to fuel pressure downstream of the axially lower one of the two seats. This also has benefit for injection at a higher rate. The twin valve needle seat 16 is described in our co-pending European patent application of even date. The injector shown in FIGS. 1 and 2 has such a twin valve seat 16.

Figure 3:
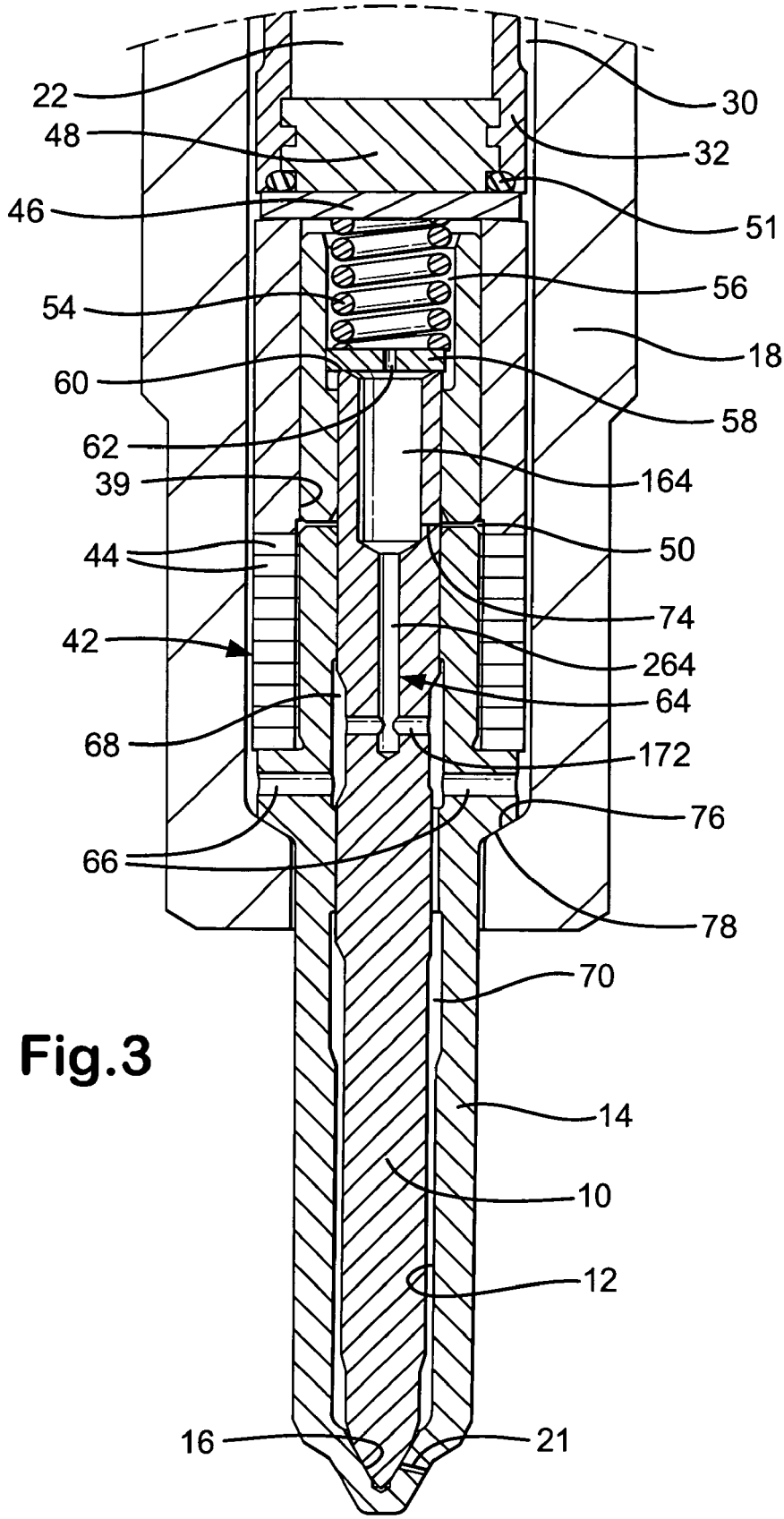
FIGS. 3 to 5 are enlarged sectional views, similar to that in FIG. 2, of alternative embodiments of the fuel injector of the present invention.

FIG. 3 shows an alternative embodiment of the fuel injector, in which similar parts to those shown in FIGS. 1 and 2 are identified with like reference numerals. Many features of the injector in FIG. 3 are identical to those in FIGS. 1 and 2, and so will not be described in detail again. In contrast to the embodiment in FIGS. 1 and 2, in the embodiment of FIG. 3 the axial flow path 64 through the valve needle 10 does not extend to the valve needle tip 11, but instead terminates part way along the valve needle axis. The axial flow path 64 includes an enlarged diameter upper end region 164 and a reduced diameter lower end region 264 which communicates with upper radial flow paths 172 in the valve needle 10. A further modification is that the valve needle 10 has just a single valve needle seat 16, as opposed to the twin needle seat of the embodiment of FIGS. 1 and 2. The extent to which flow through the axial flow path 64 influences valve needle lift is less significant in FIG. 3 due to the axial flow path 64 being shorter, but nonetheless this may be adequate for some applications. Additionally, the provision of a shorter axial drilling through the valve needle 10 to define the axial flow path 64 is easier to manufacture.

Figure 4:
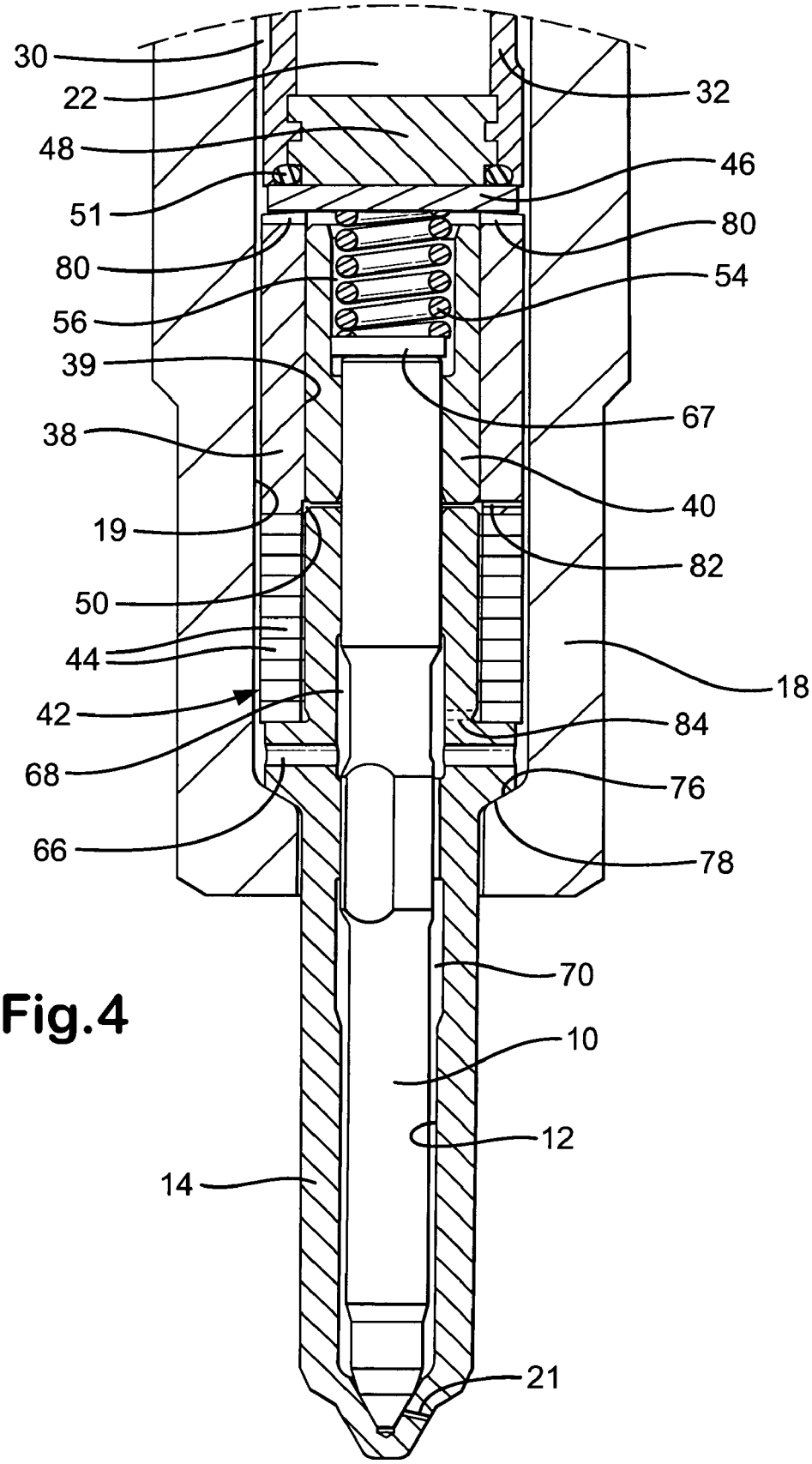

FIG. 4 shows a further alternative embodiment of the injector, again in which similar parts to those described previously are identified with like reference numerals. In FIG. 4, the axial flow path 64 of the previous embodiments is omitted altogether. Instead, the sleeve 38 is provided with first and second radial drillings 80 which define flow paths for fuel between the spring chamber 56 and the accumulator volume 30. As the valve needle 10 is caused to lift from its seat 16 to initiate injection, there is a slight reduction in pressure within the accumulator volume 30 due to the flow of fuel through the outlets 21. Fuel within the spring chamber 56 therefore flows through the flow passages 80 to the accumulator volume 30 and, hence, the downward hydraulic force acting on the valve needle 10 due to fuel within the spring chamber 56 is reduced slightly, aiding needle lift. It is one benefit of this embodiment that the valve needle 10 need not be provided with an axially extending drilling, although performance for high injection flow rates may be compromised slightly.

Due to there being no drilling 64 through the valve needle 10 in the FIG. 4 embodiment, it is necessary to provide an alternative means for ensuring closure of the valve needle 10 in the event that the piezoelectric stack 22 becomes stuck in the extended (injecting) state. For this purpose, a restricted drilling 82 may be provided at the lower end of the sleeve 38 to provide a constant communication path of restricted flow area between the control chamber 50 and the accumulator volume 30.

As an alternative to providing the restricted drilling 82, a clearance may be defined between the lower end of the sleeve 38 and the upper end of the bellows 42 (i.e. the upper end one of the disc springs 44) to provide the aforementioned flow path between the control chamber 50 and the accumulator volume 30.

In a further alternative embodiment, a restricted drilling 84 (as shown in dashed lines) may be provided in the upper end of the nozzle body 14 to provide a constant communication path of restricted flow area between the accumulator volume 30 and the control chamber 50 by virtue of the clearance between the radially inner surface of the bellows 42 and the radially outer surface of the nozzle body 14 which extends into the bellows 42. One end of the nozzle body drilling 84 communicates with the annular groove 68 on the outer surface of the valve needle 10 and the other end of the drilling 84 communicates with the aforementioned clearance. Whether the restricted nozzle body drilling 84 or the clearance gap 82 is provided, in the event that the stack 22 becomes stuck in its extended state with high fuel pressure in the control chamber 50, eventually the restricted flow of fuel from the control chamber 50, through the restricted flow area, 82 or 84, will equalise with that in the accumulator volume 30 causing the valve needle 10 to close.

In the embodiment of FIG. 4, the annular damper valve 58 shown in FIGS. 1 to 3 is not provided and so opening and closure of the valve needle occur at approximately the same rate. In this case the valve needle spring 54 acts on the upper end surface of the valve needle 10 through a shim 67. The provision of the shim enables adjustment of the spring preload (i.e. by using shims of different size), but in an alternative embodiment the shim 67 may be removed and the valve needle spring 54 may act directly on the upper end of the valve needle 10.

Although the present invention is directed towards providing an energise-to-inject injector, in which an increase in the voltage level across the stack 22 initiates opening movement of the valve needle 10, the injector of FIG. 4 can be configured to operate as a de-energise-to-inject injector in which the voltage level across the stack 22 is decreased from a usually high voltage level to initiate valve needle opening movement. The modification may be achieved by reducing the size of the drillings 80 at the upper end of the sleeve 38 and additionally by enlarging the size of clearance gap 82 between the sleeve 38 and the bellows 42.

The enlarged flow path through the gap 82 between the chamber 50 and the accumulator volume 30 ensures fuel pressure within the chamber 50 is always high (i.e. fuel pressure in the chamber 50 is no longer "controlled"). In a non-injecting condition, the voltage across the stack 22 is relatively high ("the initial voltage level"), the stack 22 is extended and the bellows 42 are compressed. Fuel pressure within the control chamber 50 is high, but the spring 54 is selected so that the spring force acting on the valve needle 10, which acts in combination with fuel pressure within the spring chamber 56, keeps the valve needle seated. When it is required to inject fuel, the voltage across the stack 22 is reduced ("the injecting voltage level") to cause the stack 22 to contract. As the stack 22 is drawn upwards the volume of the spring chamber 56 is increased. Fuel within the accumulator volume 30 is only able to flow into the chamber 56 at a relatively low rate due to the restricted flow path provided by the drilling 80 in the sleeve 38. The increase in the volume of the spring chamber 56 therefore results in a reduced force acting on the valve needle 10 due to reduced pressure within the chamber 56 and a point will be reached at which the downward force acting on the valve needle 10 and the control piston 40 is reduced to a sufficiently low level that the upward force acting on the valve needle 10 and the control piston 40 causes the needle 10 to lift from its seat 16.

In the embodiment of FIG. 4 designed for de-energise-to-inject operation, the lower chamber 50 between the upper end of the nozzle body 14 and the lower end of the sleeve 38 and the upper chamber 56 at the upper end of the valve needle 10 provide reverse functions to the equivalent chambers 50, 56 in the energise-to-inject embodiments. In the de-energise-to-inject injector, it is by controlling fuel pressure in the upper chamber 56, through extension and contraction of the stack 22, that movement of the valve needle 10 is controlled, whereas the chamber 50, which is always at relatively high pressure, influences the rate of opening and closing movement of the valve needle 10. In the energise-to-inject injector, valve needle movement is controlled by controlling fuel pressure in the lower chamber 50, with the spring chamber 56 providing a damping effect for opening movement of the valve needle 10 (and closing movement in the absence of the damper valve 58).

Figure 5:
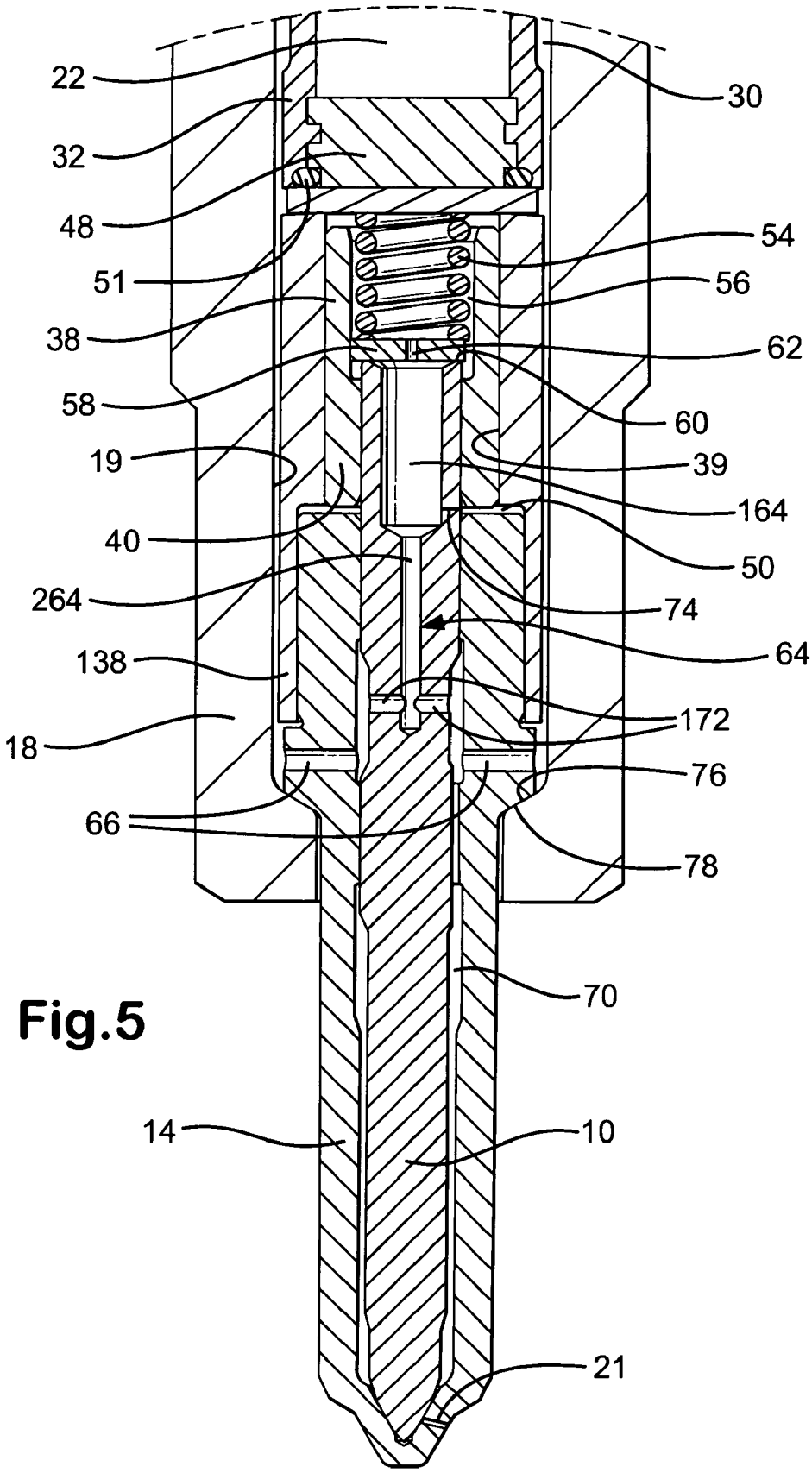

A further alternative embodiment of an energise-to-inject injector is shown in FIG. 5, in which the bellows 42 have been removed. Instead, the sleeve 38 includes a main sleeve body at its upper end and an elongate and downwardly depending annular skirt 138 at its lower end. The annular skirt 138 is shaped to define an internal diameter which is greater than the diameter of the bore 39 in the main body of the sleeve 38. The valve needle 10 is provided with a shortened axially extending drilling to define the axial flow path 64, as in the embodiment of FIG. 3. The control chamber 50 communicates with the axial flow path 64 in the valve needle 10 through a restricted valve needle drilling 74 (as in FIGS. 1 to 3) to provide a means for ensuring the valve needle 10 closes automatically in the event that the piezoelectric stack 22 becomes stuck in an extended state.

Operation of the embodiment of FIG. 5 is similar to FIGS. 1 and 2, and FIG. 3. As the piezoelectric stack 22 is extended, a downward force is applied to the sleeve 38 and, hence, the annular skirt 138. The internal diameter of the skirt 138 defines a close clearance with the outer surface of the nozzle body 14 so that fuel becomes trapped within the clearance. Thus, as the skirt 138 is forced downwards upon extension of the stack 22, fuel pressure increases in the control chamber 50 to cause the control piston 40, and hence the valve needle 10, to lift. One difference between the previous embodiments and that in FIG. 5 is that the sleeve 38 in FIG. 5 does not have a through bore, but instead includes an upper end part 138 and, hence, a separate load transmitting member 46 is not required.

Manufacture of the embodiment of FIG. 5, in which the annular skirt 138 is provided on the sleeve 38 in preference to the bellows 42, may be more difficult to achieve within acceptable tolerances due to the requirement for good concentricities between parts 38 and 14 to prevent jamming.

The invention claimed is:

1. A fuel injector for use in an internal combustion engine, the fuel injector comprising:

a valve needle which is movable within a nozzle body and engageable with a valve needle seat to control fuel injection through an injector outlet, wherein a valve needle chamber for receiving fuel is defined at an end of the valve needle;

an actuator arranged within an actuator housing so as to control fuel pressure within a control chamber, a surface associated with the valve needle being exposed to fuel pressure within the control chamber;

a fuel delivery path for delivering fuel to the injector outlet when the valve needle is lifted from the valve needle seat, the valve needle seat being provided with a communication path between the fuel delivery path and the valve needle chamber to aid opening movement of the valve needle; and a load transmitter for transmitting movement of the actuator to the valve needle, wherein the load transmitter includes a bellows arrangement which is compressible and expandable in response to said actuator movement so as to vary fuel pressure within the control chamber and control movement of the valve needle relative to the valve needle seat;

wherein one end of the nozzle body is received within the actuator housing so that a lower end of the nozzle body projects therefrom and wherein the nozzle body defines an external seating surface for abutment with an internal abutment surface of the actuator housing;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

2. A fuel injector for use in an internal combustion engine, the fuel injector comprising:

a valve needle which is engageable with a valve needle seat to control fuel injection through an injector outlet;

an actuator arranged to control fuel pressure within a control chamber, a surface associated with the valve needle being exposed to fuel pressure within the control chamber;

a load transmitter for transmitting movement of the actuator to the valve needle, wherein the load transmitter includes a bellows arrangement which is compressible and expandable in response to said actuator movement so as to vary fuel pressure within the control chamber and control movement of the valve needle relative to the valve needle seat;

wherein the load transmitter means further includes a sleeve, the sleeve being cooperable with the bellows arrangement so as to impart movement of the actuator to the bellows arrangement;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

3. The fuel injector as claimed in claim 2, wherein the surface associated with the valve needle is defined by a control piston which is coupled to the valve needle, wherein the control piston is slidable within the sleeve in response to fuel pressure variations within the control chamber.

4. The fuel injector as claimed in claim 2, wherein the valve needle is slidable directly within the sleeve in response to fuel pressure variations within the control chamber.

5. The fuel injector as claimed in claim 2, further comprising a further restricted flow path in communication with the control chamber to allow fuel to escape from the control chamber at a restricted rate so as to ensure eventual closure of the valve needle in the event of failure of the actuator.

6. The fuel injector as claimed in claim 5, wherein the further restricted flow path is defined within the sleeve to allow fuel to escape from the control chamber.

7. The fuel injector as claimed in claim 5, wherein the restricted flow path is defined within the nozzle body to allow fuel to escape from the control chamber.

8. A fuel injector for use in an internal combustion engine, the fuel injector comprising:

a valve needle which is engageable with a valve needle seat to control fuel injection through an injector outlet, wherein a valve needle chamber for receiving fuel is defined at an end of the valve needle;

an actuator ranged to control fuel pressure within a control chamber, a surface associated with the valve needle being exposed to fuel pressure within the control chamber;

a fuel delivery path for delivering fuel to the injector outlet when the valve needle is lifted from the valve needle seat, the valve needle seat being provided with a communication path between the fuel delivery path and the valve needle chamber to aid opening movement of the valve needle; and a load transmitter for transmitting movement of the actuator to the valve needle, wherein the load transmitter includes a bellows arrangement which is compressible and expandable in response to said actuator movement so as to vary fuel pressure within the control chamber and control movement of the valve needle relative to the valve needle seat;

wherein the bellows arrangement includes a plurality of disc spring elements arranged in concertina fashion;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

9. A fuel injector for use in an internal combustion engine, the fuel injector comprising:

a valve needle which is engageable with a valve needle seat to control fuel injection through an injector outlet;

an actuator arranged to control fuel pressure within a control chamber, a surface associated with the valve needle being exposed to fuel pressure within the control chamber; and a load transmitter for transmitting movement of the actuator to the valve needle, wherein the load transmitter includes a bellows arrangement which is compressible and expandable in response to said actuator movement so as to vary fuel pressure within the control chamber and control movement of the valve needle relative to the valve needle seat;

wherein the bellows arrangement includes a plurality of disc spring elements arranged in concertina fashion wherein the load transmitter means further includes a sleeve, the sleeve being cooperable with the bellows arrangement so as to impart movement of the actuator to the bellows arrangement;

wherein the valve needle is movable within a bore provided in a nozzle body, and wherein an end one of the disc springs is sealingly engaged with the nozzle body and another end one of the disc springs is sealingly engaged with the sleeve;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that the fuel flow can by-pass said restricted flow path, thereby to ensure closing movement of the valve needle is substantially undamped.

10. A fuel injector for use in an internal combustion engine, the fuel injector comprising:

a valve needle which is movable within a nozzle body and engageable with a valve needle seat to control fuel injection through an injector outlet, wherein a valve needle chamber for receiving fuel is defined at an end of the valve needle a valve needle which is movable within a nozzle body and engageable with a valve needle seat to control fuel injection through an injector outlet, wherein the valve needle seat is defined at one end of the valve needle and a valve needle chamber for receiving fuel is defined at the other end of the valve needle;

an actuator arranged within an actuator housing so as to control fuel pressure within a control chamber, a surface associated with the valve needle being exposed to fuel pressure within the control chamber;

a fuel delivery path for delivering fuel to the injector outlet when the valve needle is lifted from the valve needle seat, the valve needle seat being provided with a communication path between the fuel delivery path and the valve needle chamber to aid opening movement of the valve needle; and a load transmitter for transmitting movement of the actuator to the valve needle, wherein the load transmitter includes a bellows arrangement which is compressible and expandable in response to said actuator movement so as to vary fuel pressure within the control chamber and control movement of the valve needle relative to the valve needle seat;

wherein one end of the nozzle body is received within the actuator housing so that a lower end of the nozzle body projects therefrom and wherein the nozzle body defines an external seating surface for abutment with an internal abutment surface of the actuator housing;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle seat so that fuel flows between the chamber and die communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

11. The fuel injector as claimed in claim 10, wherein the valve needle chamber houses a valve needle spring which is arranged to urge the valve needle into engagement with the valve needle seat.

12. A fuel injector for use in an internal combustion engine, the fuel injector comprising:

a valve needle which is movable within a nozzle body and engageable with a valve needle seat to control fuel injection through an injector outlet;

an actuator arranged within an actuator housing so as to control fuel pressure within a control chamber, a surface associated with the valve needle being exposed to fuel pressure within the control chamber; and a load transmitter for transmitting movement of the actuator to the valve needle, wherein the load transmitter includes a bellows arrangement which is compressible and expandable in response to said actuator movement so as to vary fuel pressure within the control chamber and control movement of the valve needle relative to the valve needle seat; and a fuel delivery path for delivering fuel to the injector outlet when the valve needle is lifted from the valve needle seat and wherein the valve needle is provided with a communication path between the fuel delivery path and the valve needle chamber to aid opening movement of the valve needle;

wherein one end of the nozzle body is received within the actuator housing so that a lower end of the nozzle body projects therefrom and wherein the nozzle body defines an external seating surface for abutment with an internal abutment surface of the actuator housing, wherein the valve needle seat is defined at one end of the valve needle and a valve needle chamber for receiving fuel is defined at the other end of the valve needle;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle sear so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

13. The fuel injector as claimed in claim 12, further comprising a restriction for allowing fuel to escape from the control chamber at a restricted rate into the communication path so as to ensure eventual closure of the valve needle in the event of failure of the actuator.

14. A fuel injector for use in an internal combustion engine, the fuel injector comprising:

a valve needle which is engageable with a valve needle seat to control fuel injection trough an injector outlet;

an actuator arranged to control fuel pressure within a control chamber, a surface associated with the valve needle being exposed to fuel pressure within the control chamber;

a load transmitter for transmitting movement of the actuator to the valve needle, wherein die load transmitter includes a bellows arrangement which is compressible and expandable in response to said actuator movement so as to vary fuel pressure within the control chamber and control movement of the valve needle relative to the valve needle seat, wherein the valve needle seat is defined at one end of the valve needle and a valve needle chamber for receiving fuel is defined at the other end of the valve needle;

further comprising a fuel delivery path for delivering fuel to the injector outlet when the valve needle is lifted from the valve needle seat and wherein the valve needle is provided with a communication path between the fuel delivery path and the valve needle chamber to aid opening movement of the valve needle;

wherein the communication path includes an axial flow path within the valve needle to provide communication between the fuel delivery path and the valve needle chamber;

wherein the communication path is provided with a damper valve arranged to define a restricted flow path between the axial flow path and the valve needle chamber;

wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

15. The fuel injector as claimed in claim 14, wherein the communication path further includes at least one radial flow path provided in the valve needle, one end of which communicates with the fuel delivery path and the other end of which communicates with the axial flow path.

16. A fuel injector for use in an internal combustion engine, the fuel injector comprising:

a valve needle which is engageable with a valve needle seat to control fuel injection through an injector outlet, wherein a valve needle chamber for receiving fuel is defined at an end of the valve needle;

an actuator arranged to control fuel pressure within a control chamber, a surface associated with the valve needle being exposed to fuel pressure within the control chamber;

a fuel delivery path for delivering fuel to the injector outlet when the valve needle is lifted from the valve needle seat, the valve needle seat being provided with a communication path between the fuel delivery path and the valve needle chamber to aid opening movement of the valve needle; and a load transmitter for transmitting movement of the actuator to the valve needle, wherein the load transmitter includes a bellows arrangement which is compressible and expandable in response to said actuator movement so as to vary fuel pressure within the control chamber and control movement of the valve needle relative to the valve needle seat;

wherein the actuator is ax-ranged within an actuator housing, one end of an injector nozzle body being received within the actuator housing so that the other end of the nozzle body projects therefrom, and wherein the nozzle body defines an external seating surface of substantially part-spherical form for abutment with an internal abutment surface of the actuator housing;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

17. A fuel injector for use in an internal combustion engine, the fuel injector comprising:

a valve needle which is engageable with a valve needle seat to control fuel injection through an injector outlet;

an actuator arranged to control fuel pressure within a control chamber, a surface associated with the valve needle being exposed to fuel pressure within the control chamber;

a load transmitter for transmitting movement of the actuator to the valve needle, wherein the load transmitter includes a bellows arrangement which is compressible and expandable in response to said actuator movement so as to vary fuel pressure within the control chamber and control movement of the valve needle relative to the valve needle seat;

wherein the load transmitter takes the form of a motion inverter for converting movement of the actuator in one direction into movement of the valve needle in substantially the opposite direction;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

18. A load transmission device for use in a fuel injector comprising:

a valve needle which is engageable with a valve needle seat to control fuel injection through an injector outlet, wherein a valve needle chamber for receiving fuel is defined at an end of the valve needle;

an actuator arranged to control fuel pressure within a control chamber, a surface associated with the valve needle being exposed to fuel pressure within the control chamber;

a fuel delivery path for delivering fuel to the injector outlet when the valve needle is lifted from the valve needle seat, the valve needle seat being provided with a communication path between the fuel delivery path and the valve needle chamber to aid opening movement of the valve needle; and a load transmitter for transmitting movement of the actuator to the valve needle, wherein the load transmitter includes a bellows arrangement which is compressible and expandable in response to said actuator movement so as to vary fuel pressure within The control chamber and control movement of the valve needle relative to the valve needle seat;

the load transmission device being operable to transmit actuation of the actuator to an injector component, in use, the load transmission device including a bellows arrangement including a plurality of disc spring members arranged in a stack;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that the flow can by-pass said restricted flow path, thereby to ensure closing movement of the valve needle is substantially undamped.

19. A fuel injector for use in an internal combustion engine, the injector including:

a valve needle which is movable within a nozzle body and engageable with a valve needle seat to control fuel injection through an injector outlet, wherein a valve needle chamber for receiving fuel is defined at an end of the valve needle;

an actuator arranged to control fuel pressure within a control chamber, the actuator being arranged within an actuator housing, a surface of the valve needle being exposed to fuel pressure within the control chamber, wherein fuel pressure within the control chamber acts to urge the valve needle to disengage the valve needle seat;

a damper chamber for receiving fuel and being arranged at one end of the valve needle so that a surface associated with the valve needle is exposed to fuel pressure within the damper chamber, wherein fuel pressure within the damper chamber acts to urge the valve needle to engage the valve needle seat;

a fuel delivery path for delivering fuel to the injector outlet when the valve needle disengages the valve needle seat, the valve needle seat being provided with a communication path between the fuel delivery path and the valve needle chamber to aid opening movement of the valve needle; and a communication path between the fuel delivery path and the damper chamber for transmitting a reduction in pressure within the fuel delivery path to the damper chamber when the valve needle disengages the valve needle seat so as to aid opening movement of the valve needle;

wherein one end of the nozzle body is received within the actuator housing so that a lower end of the nozzle body projects therefrom and wherein the nozzle body defines an external seating surface for abutment with an internal abutment surface of the actuator housing;

wherein the communication path includes an axial flow path within the valve needle to provide communication between the fuel delivery path and the valve needle chamber;

wherein the communication path is provided with a damper valve arranged to define a restricted flow path between the axial flaw path and the valve needle chamber;

wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

20. A fuel injector for use in an internal combustion engine, the injector including:

a valve needle which is engageable with a valve needle seat to control fuel injection through an injector outlet;

an actuator arranged to control fuel pressure within a control chamber, a surface of the valve needle being exposed to fuel pressure within the control chamber, wherein fuel pressure within the control chamber acts to urge the valve needle to disengage the valve needle seat;

a damper chamber for receiving fuel and being arranged at one end of the valve needle so that a surface associated with the valve needle is exposed to fuel pressure within the damper chamber, wherein fuel pressure within the damper chamber acts to urge the valve needle to engage the valve needle seat;

a fuel delivery path for delivering fuel to the injector outlet when the valve needle disengages the valve needle seat; and a communication path between the fuel delivery path and the damper chamber for transmitting a reduction in pressure within the fuel delivery path to the damper chamber when the valve needle disengages the valve needle seat so as to aid opening movement of the valve needle;

wherein the communication path includes an axial flow path provided within the valve needle to provide communication between the fuel delivery path and the valve needle chamber;

wherein the communication path is provided with a damper valve arranged to define a restricted flow path between the axial flow path and the valve needle chamber;

wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

21. The fuel injector as claimed in claim 20, wherein the communication path further includes at least one radial flow path provided in the valve needle, one end of which communicates with the fuel delivery path and the other end of which communicates with the axial flow path.

22. The fuel injector as claimed in claim 20, wherein the communication path includes a damper valve arranged to define a restricted flow path between the axial flow path and the chamber.

23. A fuel injector for use in an internal combustion engine, the injector including:

a valve needle which is movable within a nozzle body and engageable with a valve needle seat to control fuel injection through an injector outlet;

an actuator arranged to control fuel pressure within a control chamber, the actuator being arranged within an actuator housing, a surface of the valve needle being exposed to fuel pressure within the control chamber, wherein fuel pressure within the control chamber acts to urge the valve needle to disengage the valve needle seat;

a damper chamber for receiving fuel and being arranged at one end of the valve needle so that a surface associated with the valve needle is exposed to fuel pressure within the damper chamber, wherein fuel pressure within the damper chamber acts to urge the valve needle to engage the valve needle seat;

a fuel delivery path for delivering fuel to the injector outlet when the valve needle disengages the valve needle seat;

a communication path between the fuel delivery path and the damper chamber for transmitting a reduction in pressure within the fuel delivery path to the damper chamber when the valve needle disengages the valve needle seat so as to aid opening movement of the valve needle; and a load transmitter for transmitting movement of the actuator to the valve needle, the load transmitter including a sleeve within which the valve needle, or a member coupled thereto, is slidable;

wherein one end of the nozzle body is received within the actuator housing so that a lower end of the nozzle body projects therefrom and wherein the nozzle body defines an external seating surface for abutment with an internal abutment surface of the actuator housing; and wherein the communication path is defined within said sleeve to provide a restricted flow path for fuel between the damper chamber and the fuel delivery path;

wherein the communication path is provided with a damper valve arranged to define a restricted flow path between the axial flow path and the valve needle chamber; and wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped.

24. A fuel injector for use in an internal combustion engine, the fuel injector including:

a valve needle which is movable within a bore provided in a nozzle body and engageable with a valve needle seat to control fuel injection through an injector outlet;

a fuel delivery path for delivering fuel to the injector outlet when the valve needle is lifted from the valve needle seat, the valve needle having a communication path between the fuel delivery path and the valve needle bore to aid opening movement of the valve needle and an actuator for controlling movement of the valve needle, the actuator being arranged within an actuator housing;

wherein one end of the nozzle body is received within the actuator housing so that a lower end of the nozzle body projects therefrom;

wherein the communication path includes an axial flow path provided to provide communication between the fuel delivery path and the valve needle chamber;

wherein the communication path is provided with a damper valve arranged to define a restricted flow path between the axial flow path and the valve needle chamber;

wherein the damper valve includes a damper valve member which is engageable with a seating, wherein the damper valve member has (i) a seated position in circumstances in which the valve needle is lifting away from the valve needle seat so that fuel flows between the chamber and the communication path through the restricted flow path, thereby to damp opening movement of the valve needle, and (ii) a lifted position in circumstances in which the valve needle is moving towards the valve needle seat so that fuel flow can by-pass said restricted flow path, thereby to ensure closing movement of the valve needle is substantially undamped; and wherein the nozzle body defines an external seating surface of substantially part-spherical form for abutment with an internal abutment surface of the actuator housing.

* * * * *